US005775280A

United States Patent [19]

Schmidt et al.

[11] Patent Number: 5,775,280

[45] Date of Patent: Jul. 7, 1998

[54] SECURING DEVICE FOR AN ACTUATING LEVER IN A VALVE CONTROL MECHANISM OF INTERNAL COMBUSTION ENGINES

[75] Inventors: Dieter Schmidt, Nürnberg; Günter Eisenhardt, Neuhaus; Norbert Geheeb, Bamberg; Peter Sailer, Erlangen; Helmut Engelhardt, Herzogenaurach; Wolfgang Mayer, Seukendorf, all of Germany

[73] Assignee: INA Wälzlager Schaeffler KG, Herzogenaurach, Germany

[21] Appl. No.: 847,277

[22] Filed: May 1, 1997

[30] Foreign Application Priority Data

May 2, 1996 [DE] Germany ..... 196 17 523.2

[51] Int. Cl.[6] ..... F01L 1/12

[52] U.S. Cl. ..... 123/90.41; 123/90.44

[58] Field of Search ..... 123/90.27, 90.39, 123/90.41, 90.43, 90.44, 90.45; 74/519, 559

[56] References Cited

U.S. PATENT DOCUMENTS

| | | | |
|---|---|---|---|
| 3,002,507 | 10/1961 | Bensinger et al. | 123/90.41 |
| 3,139,872 | 7/1964 | Thompson | 123/90.41 |
| 3,166,058 | 1/1965 | Zink | 123/90.41 |
| 4,369,740 | 1/1983 | Seidl | 123/90.44 |
| 4,494,729 | 1/1985 | Kruger | 123/90.44 |
| 4,539,953 | 9/1985 | Sasaki et al. | 123/90.41 |
| 4,598,674 | 7/1986 | Nono et al. | 123/90.41 |
| 5,211,143 | 5/1993 | Fontichiaro et al. | 123/90.39 |

FOREIGN PATENT DOCUMENTS

| | | |
|---|---|---|
| 23 09 460.2 | 2/1973 | Germany . |
| 35 00 524.6 | 1/1985 | Germany . |
| 62-261607 | 5/1986 | Japan . |
| 63-129110 | 11/1986 | Japan . |

*Primary Examiner*—Weilun Lo
*Attorney, Agent, or Firm*—Henry M. Feiereisen

[57] ABSTRACT

A device for securing an actuating lever, e.g. a finger lever, of a valve control mechanism of an internal combustion engine to a support element, with the actuating lever being formed with a concave recess receiving a spherical end of the support element for allowing the actuating lever to pivot relative to the support element includes a connecting element received in an undercut of a displaceable piston of the support element and having a thickness which is smaller than a width of the undercut to effect a free movement of the connecting element within the undercut in all pivoted positions of the actuating lever.

9 Claims, 8 Drawing Sheets

SECURING DEVICE FOR AN ACTUATING LEVER IN A VALVE CONTROL MECHANISM OF INTERNAL COMBUSTION ENGINES

BACKGROUND OF THE INVENTION

The invention concerns a device for securing an actuating lever of a valve control mechanism of an internal combustion engine to a support member, and in particular for securement of a finger lever of a type including a concave recess with which it is pivoted on a spherical end of the support member, while the support member and the finger lever are held together by a connecting element supported on the support member and on the finger lever. Furthermore, the present invention is also related to a device for securing an actuating lever to a support member, without resorting to a particular connecting element that is supported on both these parts.

Securing devices of this type are utilized to realize a structural unit of the actuating lever and the support member so that assembly problems for customers are avoided Thus, an erroneous installation of the actuating lever in the valve drive, e.g. a position turned by 180°, is thereby avoided so that the socket-type cavity of the finger lever is placed correctly on the support member and not on the valve stem end by mistake.

The use of securing elements is generally known. For instance, German Pat. No. DE 35 00 524 C2 discloses an actuating lever which is connected to a support member by a retention clip which engages a groove of the support member, on the one hand, and the actuating lever, on the other hand. In this way, a permanent positive contact is established between the support member and the actuating lever.

A drawback of this type of securement is the constant relative movement occurring between the retention clip and the actuating lever and between the retention clip and the support member, so that the valve drive is subjected to additional friction.

SUMMARY OF THE INVENTION

It is an object of the present invention to provide an improved valve drive, obviated the afore-stated drawbacks.

In particular, it is an object of the present invention to provide an improved mechanism to secure the actuating lever and the support member of a valve drive to one another, without increasing a friction in the valve drive.

These objects, and others which will become apparent hereinafter, are attained in accordance with the present invention by holding the actuating lever and the support member together by a connecting element which is received in an undercut of a displaceable piston of the support member and exhibits a thickness which is smaller than the width of the undercut so that the connecting element can move freely within the undercut in all pivoted positions of the finger lever.

In this manner, the connecting element is ensured to bear firmly against the actuating lever in all operating positions of the valve drive while at the same time is permitted to move, as a result of the pivoting motion of the actuating lever, freely within the undercut of the displaceable piston from the upper to the lower edge thereof, and vice versa. There is no need for widening the connecting element during each valve lift, i.e. the individual components of the connecting element do not execute relative movements with respect to one another which would require additional force.

Examples for use as a friction-free connecting element include a wire retention clamp, a sheet metal retention clip or a plastic retention cap.

When using a sheet metal retention clip as connecting element, the sheet metal retention clip exhibits a generally U-shaped configuration and includes a first arm which is fixed above the concave recess on the finger lever and a second, bifurcated arm which extends below the concave recess and engages into the undercut, whereby the two arms are joined together by an intermediate portion.

A connecting element in the form of a wire retention clamp includes two parallel first arms which engage into the undercut and has opposite ends which terminate in second arms extending at an angle of approximately 90° relative to the first arms, whereby at least one pair of the second arms is joined together by a third arm.

The advantage of using wire retention clamps as compared to sheet metal retention clips resides mainly in their simple and economic manufacture and their ease of mounting. Thus, for example, the support member can be hooked to the clamp from below without any problem.

Advantageously, the second arms of the wire retention clamp are formed with retaining lugs by which an absolutely reliable attachment of the wire retention clamp on the finger lever is obtained. The same result can be achieved by providing grooves in the finger lever which, as viewed in cross-section, has the shape of an upright U, with the grooves being arranged in the bottom wall of the finger lever in the region of the support member.

According to another feature of the present invention, the wire retention clamp includes a first arm which engages the undercut and has opposite ends, each of which terminates in a second arm extending at an angle of approximately 90° to the first arm. This simple type of wire retention clamp is much easier to manufacture than the two-sided wire retention clamp described above. Suitably, at least one of the two second arms of this simple wire retention clamp is fixed in a bore of the finger lever.

In accordance with another embodiment of the present invention, a securement between a finger lever and a support member is attained by forming two swaged portions which are arranged in the concave recess on opposite sides from the pivot axis and engage the undercut of the displaceable piston of the support member.

In accordance with still another embodiment of the present invention, a securement between a finger lever and a support member may be attained by applying an adhesive layer for gluing the spherical end of the support member in the concave recess of the finger lever so as to form a structural unit which can be precisely positioned in the cylinder head without any risk of a tilting of the finger lever. This type of securement has the additional advantage that the support member can be transported without risking any oil leakage. During initial ignition phase of the internal combustion engine, i.e. when the camshaft commences rotation, the adhesive joint is separated as a result of generated shear stress.

An adhesive joint between the support member and the finger lever may be effected spotwise or over surface areas depending on the adhesive and available technology.

BRIEF DESCRIPTION OF THE DRAWINGS

The above and other objects, features and advantages of the present invention will now be described in more detail with reference to the accompanying drawing in which.

DETAILED DESCRIPTION OF PREFERRED EMBODIMENTS

Figure 1:
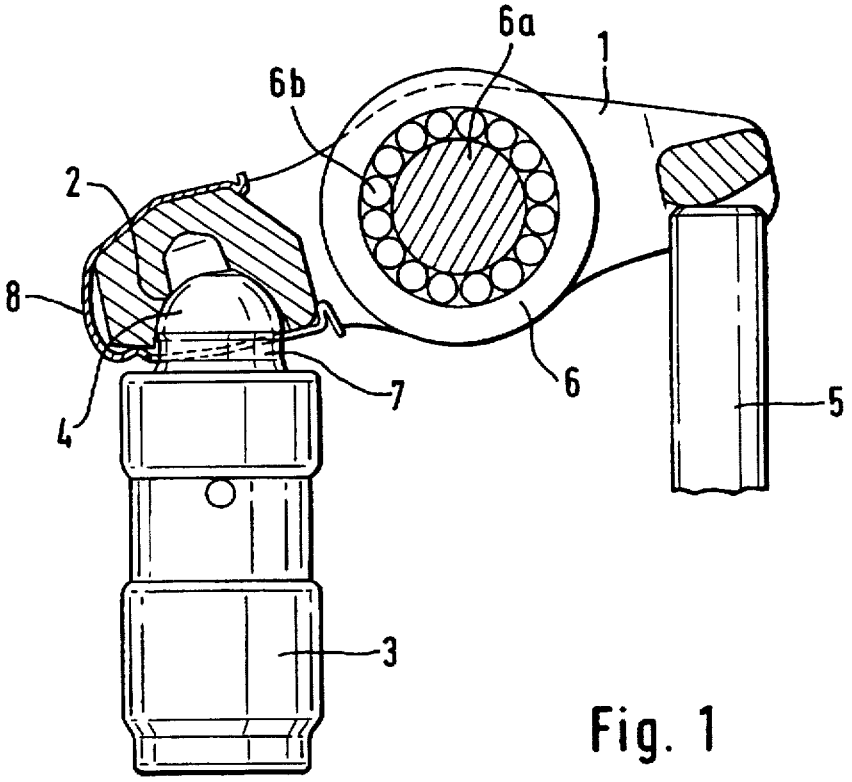
FIG. 1 is a partial sectional side view of a valve drive mechanism, with a finger lever occupying a first position.

Throughout all the Figures, the same or corresponding elements are generally indicated by the same reference numerals.

Turning now to the drawing, and in particular to FIG. 1, there is shown a partial sectional side view of a valve drive mechanism of an internal combustion engine. The valve drive mechanism includes a finger lever 1 having one end formed with a concave or cup-shaped recess 2 for receiving the spherical end 4 of a support member 3 which is disposed in a receiving bore of the cylinder head. An exemplified construction and manner in which the support member is operatively and functionally incorporated into a valve drive mechanism of an internal combustion engine is fully described in U.S. Pat. No. 5,325,825, the disclosure of which is expressly incorporated herein by reference.

The other end of the finger lever 1, opposite to the concave recess 2, engages a valve shaft 5 of a gas exchange valve. In a central area, the finger lever 1 is provided with a roller 6 which is rotatably mounted on a pin 6*a*. A needle bearing 6*b* serves to mount the roller 6 rotatably on the pin 6*a* which is supported in side walls of the finger lever 1. The roller 6 is contacted by a cam (not shown) of a camshaft (not shown) so that a rotation of the cam causes the roller 6 to roll along the periphery of the cam, thereby actuating the gas exchange valve between positions, shown in FIGS. 1 and 2.

The support member 3 is formed below the spherical end 4 with an undercut 7 for receiving a connecting element in the form of a sheet metal retention clip 8 so that the finger lever I and the support member 3 form a structural unit. As shown in particular in FIG. 3, the sheet metal retention clip 8 has a thickness which is smaller than the width of the undercut 7, so that the connecting element 8 does not spring open during pivoting movements of the finger lever 1 but bears firmly against the socket-like portion of the finger lever 1 and thus does not cause an additional increase of friction in the valve drive mechanism.

Figure 3:
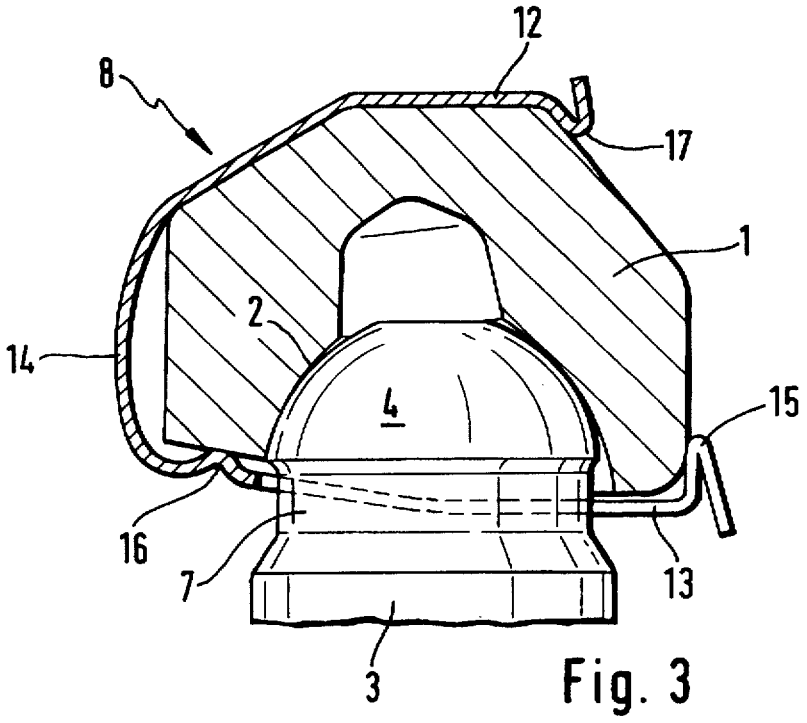
FIG. 3 is a partial sectional cutaway view, on an enlarged scale, of a connecting element in the form of sheet metal retention clip for securing the finger lever to a support member.
Figure 4:
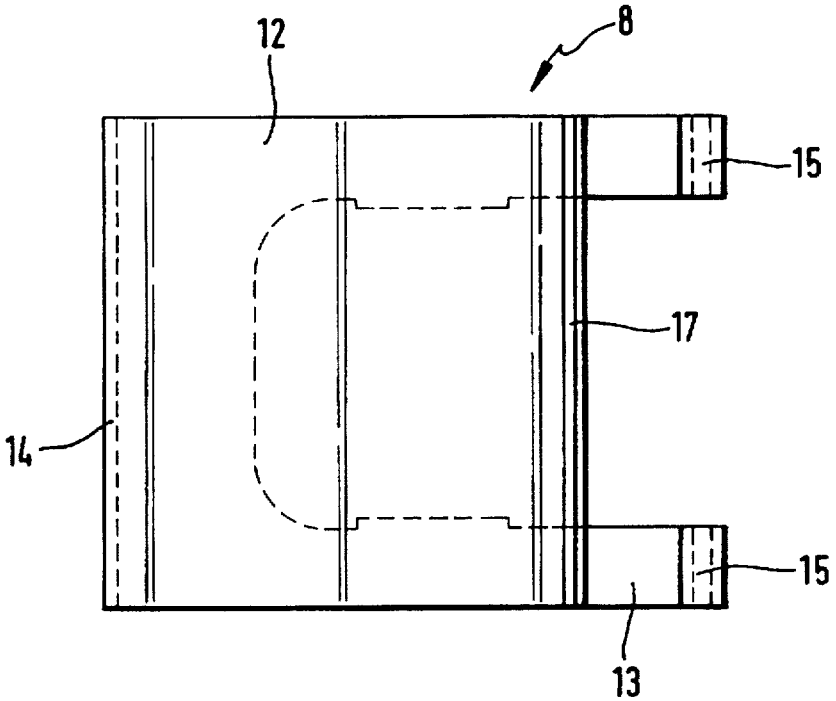
FIG. 4 is a schematic illustration of the shoot metal retention clip of FIG. 3.

As can be best seen from FIGS. 3 and 4, the sheet metal retention clip 8 exhibits a generally U-shaped configuration and is comprised of an arm 12, which engages a top surface of the finger lever 1, and a second, bifurcated arm 13 which is received in the undercut 7. An intermediate portion 14 connects the arms 12 and 13 to each other, with the arms 12, 13 additionally formed with retaining lugs 15, 16 and 17 for securing the clip 8 in place.

Figure 2:
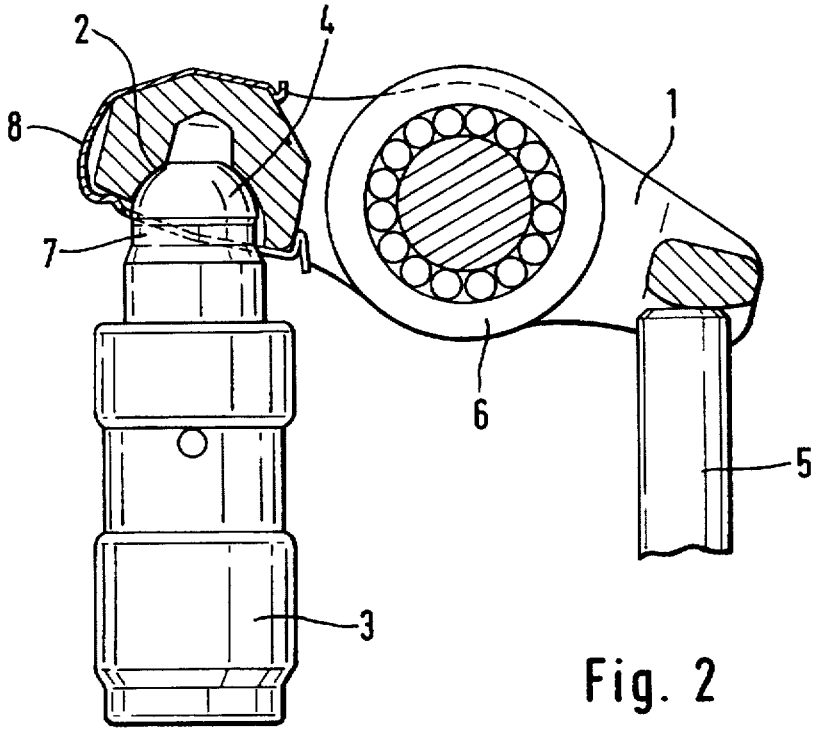
FIG. 2 is a partial sectional view of the valve drive mechanism, illustrating the finger lever occupying a second position.

FIGS. 1 and 2 show the finger lever 1 in its two extreme end positions, and it can be seen that the arm 13 (FIG. 3) of the retention clip 8 moves alternately from the upper to the lower edge and from the lower to the upper edge of the undercut 7, on the left and the right sides, respectively, during pivoting movements of the finger lever 1. The individual parts of the sheet metal retention clip 8, i. e. the arms 12, 13 and the intermediate portion 14, do not change their positions relative to one another so that the sheet metal retention clip 8 bears firmly against the finger lever 1 while the arm 13 slides up and down within the undercut 7.

Figure 5:
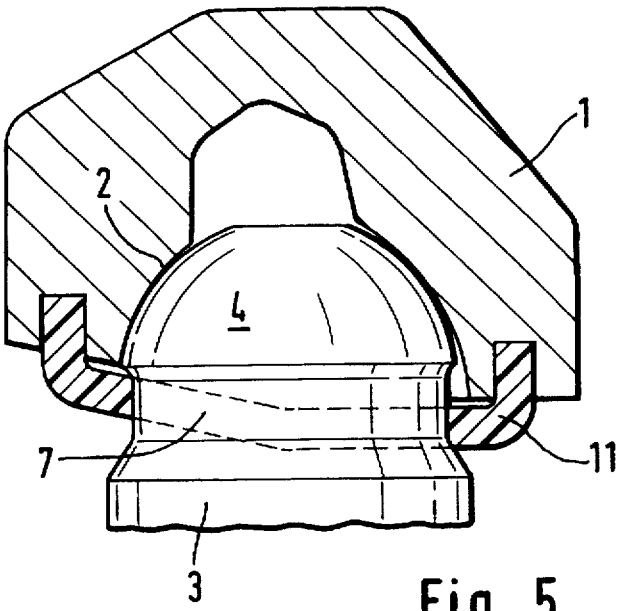
FIG. 5 is a partial sectional cutaway view, on an enlarged scale, of a connecting element in the form of a plastic retention cap for securing the finger lever to a support member.

Turning now to FIG. 5, there is shown a connecting element in the form of a plastic retention cap 11 for securing the finger lever 1 to the support member 3 which thus form together a structural unit. The retention cap 11 has also a thickness which is smaller than the width of the undercut 7 so that the cap 11 can move within the undercut 7 in a same manner as described in connection with the sheet metal retention clip 8.

Figure 6:
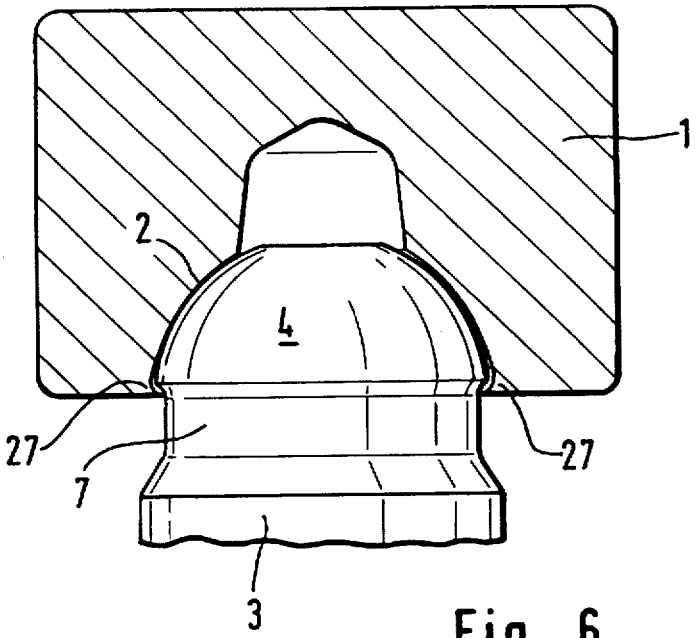
FIG. 6 is a partial sectional cutaway view, on an enlarged scale, of a securement in the form of two swaged portions for securing the finger lever to a support member.

FIG. 6 shows a partial sectional cutaway view, on an enlarged scale, of a securement in the form of two inwardly swaged portions 27 for securing the finger lever 1 to the support member 3, with the two swaged portions 27 being arranged in the concave recess 2 on opposite sides from the pivot axis of the finger lever 1 for engagement in the undercut 7 of the support member 3.

Figure 7:
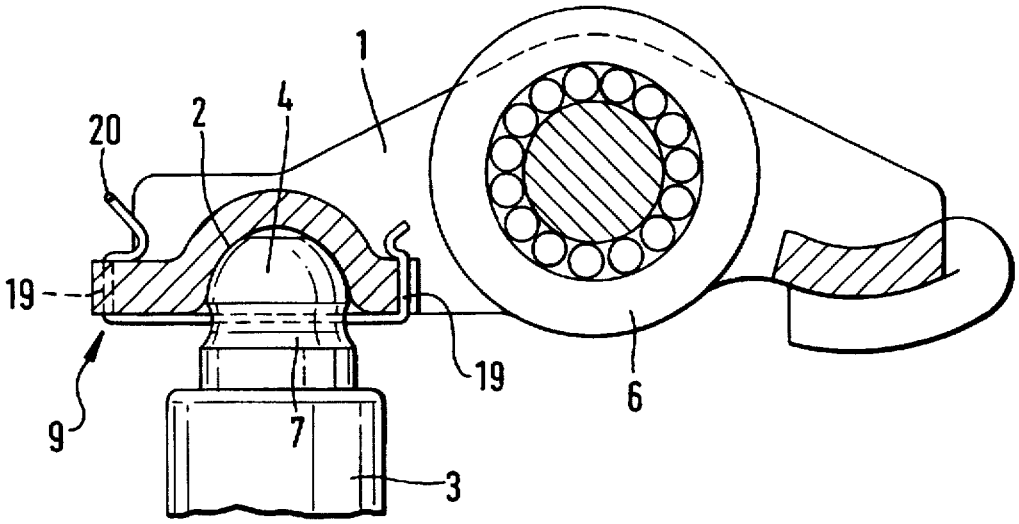
FIG. 7 is a partial sectional side view of a valve drive mechanism, illustrating another embodiment of a connecting element in the form of a wire retention clamp for securing the finger lever to a support member.

Turning now to FIG. 7, there is shown a partial sectional side view of a valve drive mechanism, illustrating another embodiment of a connecting element in the form of a double wire retention clamp 9 for securing the finger lever 3 to the support member 3 and thereby effecting a structural unit of the finger lever 1 and the support member 3. The wire retention clamp 9 has also a thickness which is smaller than the width of the undercut 7 so that the cap 9 can move within the undercut 7 in a same manner as described in connection with the sheet metal retention clip 8 or the plastic retention cap 11.

Figure 8:
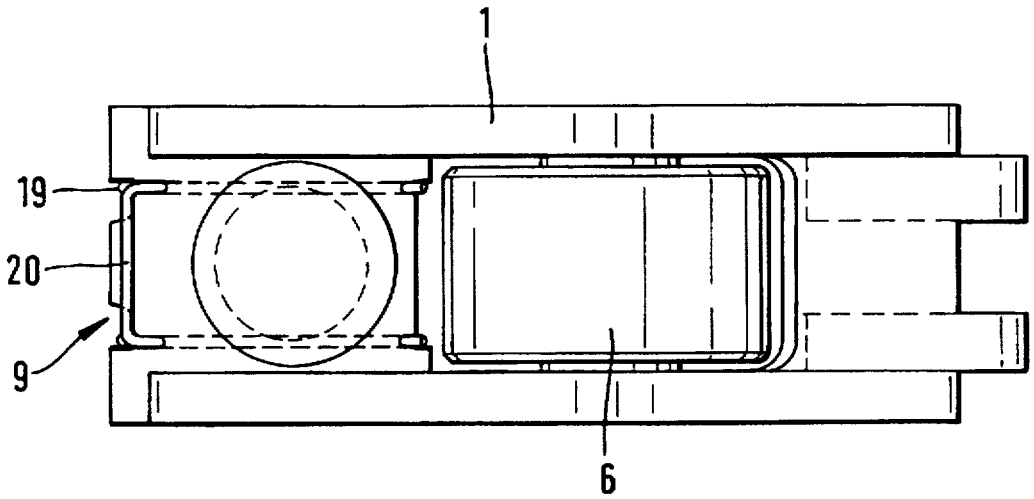
FIG. 8 is a top view of the finger lever of FIG. 7.
Figure 9:
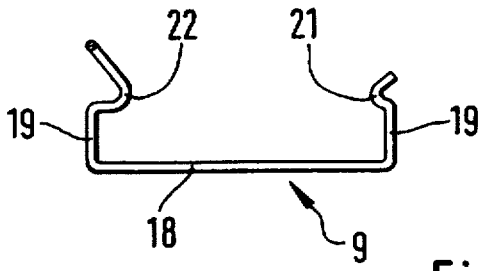
FIG. 9 is a schematic illustration of the wire retention clamp of FIG. 7.
Figure 10:
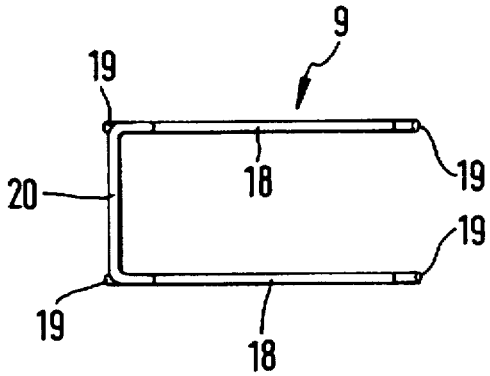
FIG. 10 is a top view of the wire retention clamp of FIG. 7.

As shown in particular in FIGS. 8 to 10, the double wire retention clamp 9 includes two parallel arms 18 which engage the undercut 7 of the support member 3. Each arm 18 has opposing ends (FIG. 9), each of which terminates in a second arm 19 which is bent inwardly at an angle of about 90° relative to the first arm 18. In the non-limiting example of FIGS. 7 to 10, the two opposite arms 19 are joined together by a third arm 20, and as best shown in FIG. 9, terminate at their free ends in retaining lugs 21, 22 for ensuring a firm seat of the clamp 9 on the finger lever 1.

Figure 11:
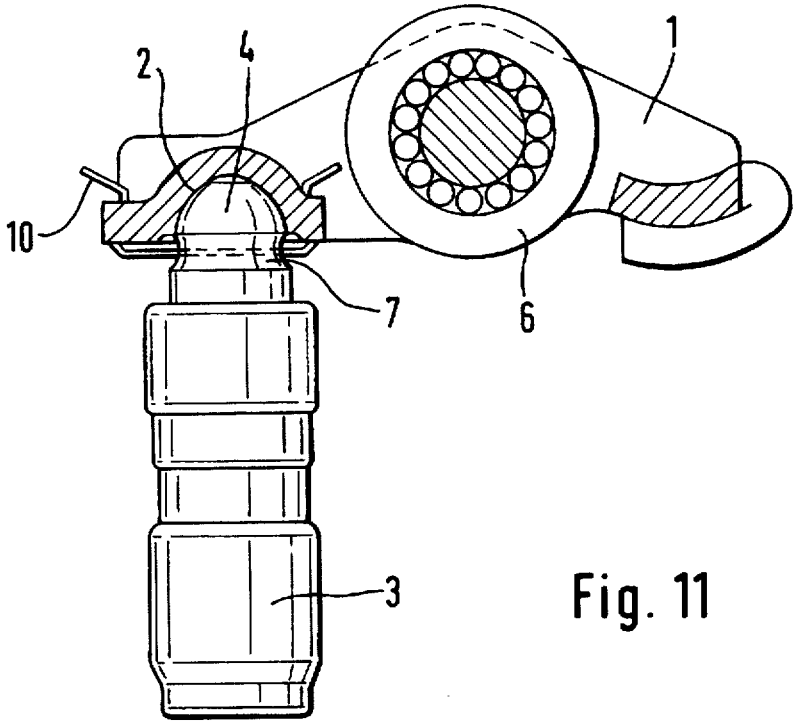
FIG. 11 is a partial sectional side view of a valve drive mechanism, illustrating a modification of a connecting element in the form of a wire retention clamp for securing the finger lever to a support member.
Figure 12:
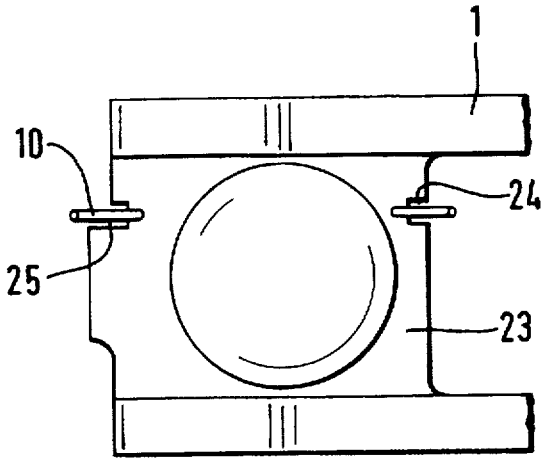
FIG. 12 is a top view of the finger lever of FIG. 11.
Figure 13:
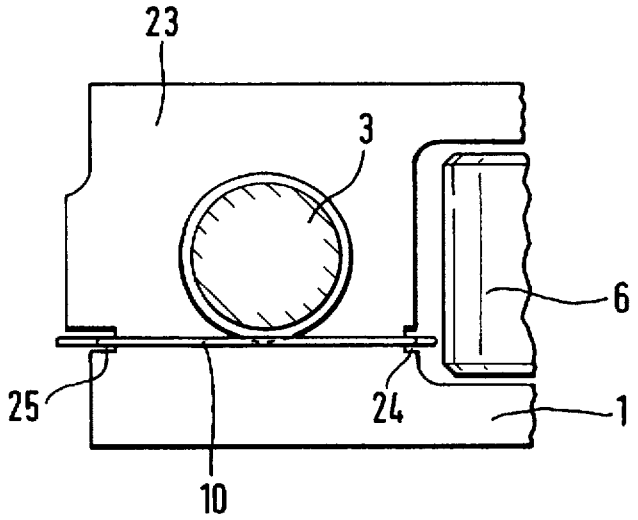
FIG. 13 is a bottom view of the finger lever of FIG. 11.
Figure 14:
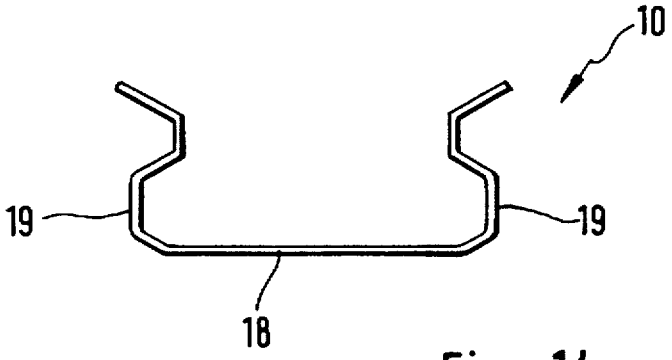
FIG. 14 is a schematic illustration of the wire retention clamp of FIG. 11.

FIG. 11 shows a modified wire retention clamp 10 which is of simplified configuration in comparison to the wire retention clamp 9. The wire retention clamp 10 includes a first arm 18 (FIG. 14) which engages the undercut 7 and has opposing ends terminating in second arms 19 extending at an angle of about 90° to the first arms 18. As shown in FIGS. 12 and 13, the finger lever 1 has a bottom wall 23 of upwardly open U-shaped configuration which is formed with grooves 24, 25 into which the arms 19 of the wire retention clamp 10 can snap in.

Figure 15:
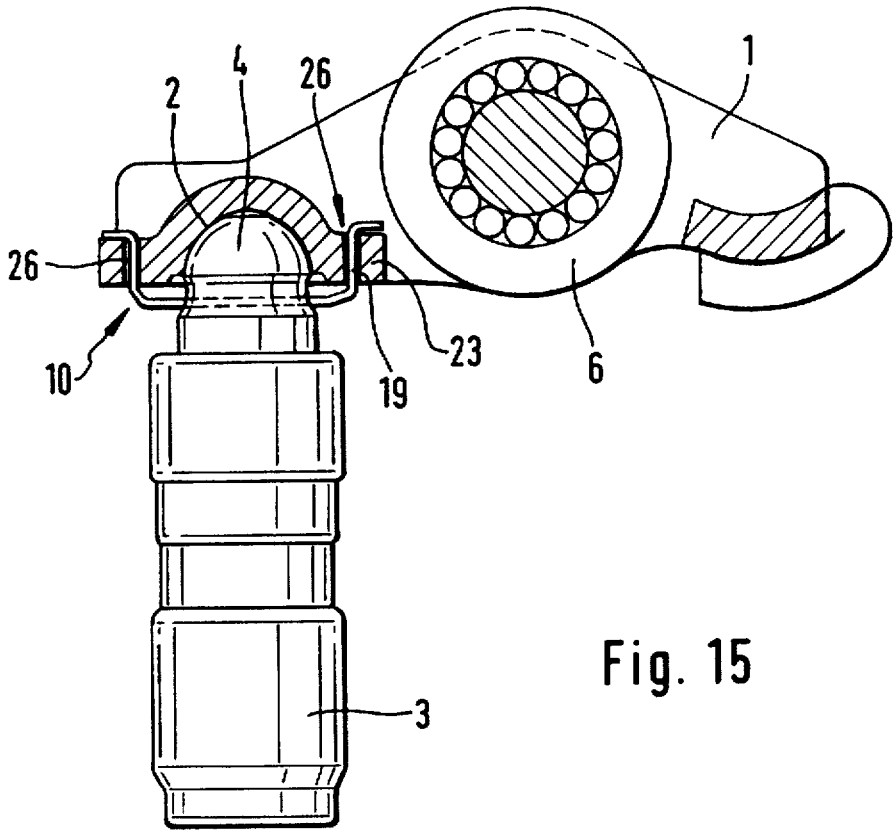
FIG. 15 is a partial sectional side view of a valve drive mechanism, illustrating a variation of securement of the connecting element in the form of a wire retention clamp of FIG. 11.

As can be seen in FIG. 15, it is also possible to have the arms 19 of the wire retention clamp 10 engage two bores 26 of the bottom wall 23. It is certainly within the scope of the present invention to secure the support member 3 also by two separate wire retention clamps 10.

While the invention has been illustrated and described as embodied in a securing device for an actuating lever in a valve control mechanism of internal combustion engines, it is not intended to be limited to the details shown since various modifications and structural changes may be made without departing in any way from the spirit of the present invention.

What is claimed as new and desired to be protected by Letters Patent is set forth in the appended claims:

1. A device for securing an actuating lever of a valve control mechanism of an internal combustion engine to a support element, with the actuating lever being formed with a concave recess receiving a spherical end of the support element for allowing the actuating lever to pivot relative to the support element, said securing device being secured to said actuating lever and comprising a connecting element received in an undercut of a displaceable piston of the support element and having a thickness which is smaller than a width of the undercut to effect a free movement of the connecting element within the undercut in all pivoted positions of the actuating lever.

2. The securing device of claim 1 wherein the connecting element is a member selected from the group consisting of wire retention clamp, sheet metal retention clip and plastic retention cap.

3. The securing device of claim 2 wherein the sheet metal retention clip has a generally U-shaped configuration and includes a first arm which is fixed at a location above the concave recess on the actuating lever, a second, bifurcated arm positioned below the concave recess and engaging the undercut, and an intermediate portion for joining the first and second arms to each other.

4. The securing device of claim 2 wherein the wire retention clamp includes two parallel first arms which are received in the undercut and have opposite ends terminating in second arms which extend at an angle of approximately 90° relative to the first arms, with at least one pair of the second arms being connected to each other by a third arm.

5. The securing device of claim 4 wherein the second arms are formed with retaining lugs.

6. The securing device of claim 1 for an actuating lever in the form of a finger lever exhibiting, as viewed in cross-section, a shape of an upright U and having formed therein grooves positioned in a bottom wall of the finger lever in a region of the support element for receiving the connecting element.

7. The securing device of claim 2 wherein the wire retention clamp is formed by a first arm engaging the undercut and having opposing ends, each of which terminating in a second arm which extends an angle of approximately 90° relative to the first arm.

8. The securing device of claim 7 wherein at least one of the second arms is fixed in a bore of the actuating lever.

9. A device for securing an actuating lever of a valve control mechanism of an internal combustion engine to a support element, said securing device being secured to said actuating lever and comprising a connecting element received in an undercut of the support element and having a thickness which is smaller than a width of the undercut so as to allow the connecting element to freely move within the undercut when the actuating lever pivots relative to the support element.

* * * * *